US009955266B2

(12) United States Patent
Liu et al.

(10) Patent No.: US 9,955,266 B2
(45) Date of Patent: Apr. 24, 2018

(54) LOUDSPEAKER DIAPHRAGM

(71) Applicant: GOERTEK INC., WeiFang (CN)

(72) Inventors: Xuelu Liu, Weifang (CN); Jianbin Yang, Weifang (CN); Ting Wang, Weifang (CN); Chao Jiang, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/313,937

(22) PCT Filed: Sep. 9, 2014

(86) PCT No.: PCT/CN2014/086109
§ 371 (c)(1),
(2) Date: Nov. 23, 2016

(87) PCT Pub. No.: WO2015/180289
PCT Pub. Date: Dec. 3, 2015

(65) Prior Publication Data

US 2017/0188155 A1 Jun. 29, 2017

(30) Foreign Application Priority Data

May 26, 2014 (CN) ..... 2014 2 0273023 U

(51) Int. Cl.
*H04R 1/00* (2006.01)
*H04R 7/12* (2006.01)
*H04R 9/06* (2006.01)

(52) U.S. Cl.
CPC ..... *H04R 7/125* (2013.01); *H04R 7/127* (2013.01); *H04R 9/06* (2013.01); *H04R 2307/025* (2013.01)

(58) Field of Classification Search
CPC . H04R 7/06; H04R 7/10; H04R 7/122; H04R 7/125
See application file for complete search history.

(56) References Cited

U.S. PATENT DOCUMENTS 4,140,203 A * 2/1979 Niguchi ..... G10K 13/00 181/166
5,259,036 A * 11/1993 Seeler ..... H04R 7/125 181/170

(Continued)

FOREIGN PATENT DOCUMENTS

CN 101252793 A 8/2008
CN 101536542 A 9/2009

(Continued)

OTHER PUBLICATIONS

International Search Report for International Patent Application No. PCT/CN2014/086109 filed on Sep. 9, 2014.

(Continued)

*Primary Examiner* — Matthew Eason
*Assistant Examiner* — Ryan Robinson

(57) ABSTRACT

The present application provides a loudspeaker diaphragm, comprising a first surface layer, a middle layer and a second surface layer, that are in a stacked structure. The loudspeaker diaphragm is characterized in that: at least one surface layer of the first surface layer and the second surface layer has a composite structure which is composed of a base layer and a reinforcing layer, and the other surface layer comprises a base layer; the base layer is a poly(ether-ether-ketone) layer, a polyarylester layer, a polyethylene terephthalate layer, a polyetherimide layer or a composite structure composed of any two of the above layers, and the reinforcing layer is a thermoplastic polyurethane elastomer layer or a thermoplastic elastomer layer. The loudspeaker diaphragm can reduce diaphragm breakage after power test is performed on a loudspeaker product, improve substrate toughness and improve acoustical property of the loudspeaker.

10 Claims, 5 Drawing Sheets

(56) References Cited

U.S. PATENT DOCUMENTS

| | | | | |
|---|---|---|---|---|
| 7,726,441 | B2 * | 6/2010 | Uryu | H04R 7/10 181/166 |
| 8,141,676 | B2 * | 3/2012 | Shen | H04R 7/10 181/167 |
| 8,496,086 | B2 * | 7/2013 | Gerkinsmeyer | H04R 7/10 181/169 |
| 9,049,511 | B2 * | 6/2015 | Shen | H04R 7/06 |
| 9,424,829 | B2 * | 8/2016 | Zhu | G10K 13/00 |
| 2015/0125692 | A1 * | 5/2015 | Mussig | H04R 7/10 428/339 |
| 2015/0312660 | A1 * | 10/2015 | Lembacher | H04R 31/003 381/396 |
| 2016/0052246 | A1 * | 2/2016 | Egger | H04R 31/003 381/426 |
| 2017/0238110 | A1 * | 8/2017 | Guo | H04R 31/003 |

FOREIGN PATENT DOCUMENTS

| | | | |
|---|---|---|---|
| CN | 202652511 | U | 1/2013 |
| CN | 103475981 | A | 12/2013 |
| CN | 203446015 | U | 2/2014 |
| CN | 103738020 | A | 4/2014 |

OTHER PUBLICATIONS

Office Action from Korean Patent Office for Korean Application No. 10-2016-7028699, dated Oct. 12, 2017.
Office Action from Korean Patent Office for Korean Application No. 10-2016-7028699, dated Apr. 10, 2017.

* cited by examiner

LOUDSPEAKER DIAPHRAGM

CROSS-REFERENCE TO RELATED APPLICATION

The present specification is a U.S. National Stage of International Patent Application No. PCT/CN2014/086109 filed Sep. 9, 2014, which claims priority to and the benefit of Chinese Patent Application No. 201420273023.5 filed on May 26, 2014, the entire contents of which are incorporated herein by reference.

TECHNICAL FIELD

The present disclosure relates to the technical field of loudspeaker, more specifically, to a loudspeaker diaphragm.

BACKGROUND ART

As a common electroacoustic transducer for converting electrical energy into acoustic energy, the speaker plays an important role in sound system. In the sound system, the speaker is the weakest component. However, as for the sound effect of the sound system, the speaker is the most important component. There are many types of speakers, and audio power enables the vibration of cones or diaphragms by galvanomagnetic effect, piezoelectric effect or electrostatic effect, and the vibration resonates with ambient air so as to make a sound. Consequently, thanks to speakers, people may enjoy wonderful sound.

The diaphragm serves as a sounding component in the loudspeaker, and its structure and material play an important role in the sounding effect. The diaphragm of a conventional micro-loudspeaker is formed by adding a core layer between two layers of films with the same or different properties. The material of the two layers of films is typically polyetheretherketone, and the material of the intermediate core layer is typically acrylic acid adhesive, so as to achieve multiple selections of the acoustic performance of the loudspeaker. However, with the increasing demands on the acoustic performance of micro-loudspeaker, the toughness of currently available composite film and polyetheretherketone is hard to meet the requirements thereof.

SUMMARY OF THE INVENTION

In view of the above problems, the objective of the present application is to provide a loudspeaker diaphragm, and by using the diaphragm, the toughness of the diaphragm may be increased, the diaphragm may be prevent from being ruptured after power test is performed on a loudspeaker product, and the reliability of the product may be improved while ensuring the acoustic performance of the micro-loudspeaker.

The application provides a loudspeaker diaphragm, comprising a first surface layer, an intermediate layer and a second surface layer in a lamination structure, and at least one surface layer of the first surface layer and the second surface layer is a composite layer composed of a base layer and a reinforcing layer, and the other surface layer comprises at least a base layer, and the base layer is any one selected from a group consisting of a polyetheretherketone layer, a polyarylester layer, a polyethylene terephthalate layer and a polyetherimide layer, or a composite layer composed of any two selected from the group; and the reinforcing layer is a thermoplastic polyurethane elastomer layer or a thermoplastic elastomer layer.

Further, preferably, one surface layer of the first surface layer and the second surface layer is coupled to a voice coil of a loudspeaker.

Further, preferably, the one surface layer coupled to the voice coil of the loudspeaker is coupled to the voice coil through its base layer.

Further, preferably, when the other surface layer only comprises the base layer, a lamination order of the loudspeaker diaphragm is as follows:

the base layer, the reinforcing layer, the intermediate layer, the base layer;

the reinforcing layer, the base layer, the intermediate layer, the base layer;

the base layer, the intermediate layer, the base layer, the reinforcing layer; or, the base layer, the intermediate layer, the reinforcing layer, the base layer. Intermediate layer.

Further, preferably, each of the first surface layer and the second surface layer is the composite layer composed of the base layer and the reinforcing layer intermediate layer.

Further, preferably, a lamination order of the loudspeaker diaphragm is as follows:

the base layer, the reinforcing layer, the intermediate layer, the base layer, the reinforcing layer;

the base layer, the reinforcing layer, the intermediate layer, the reinforcing layer, the base layer;

the reinforcing layer, the base layer, the intermediate layer, the base layer, the reinforcing layer; or, the reinforcing layer, the base layer, the intermediate layer, the reinforcing layer, the base layer.

Further, preferably, the intermediate layer is an acrylic acid adhesive layer.

Further, preferably, when the surface layer is the composite layer composed of the base layer and the reinforcing layer, the base layer bonds with the reinforcing layer by thermal compounding.

Further, preferably, a thickness of each of the first surface layer and the second surface layer is 2~30 μm.

Further, preferably, a thickness of the reinforcing layer is 5~40 μm, and a hardness of the reinforcing layer is 60~95 A Shore hardness.

BRIEF DESCRIPTION OF THE DRAWINGS

By referring to the following descriptions with reference to the accompanying drawings and the claims, and with a full understanding of the present disclosure, other purposes and results of the present disclosure will become more clearly and easily understood.

In the drawings.

Figure 1:
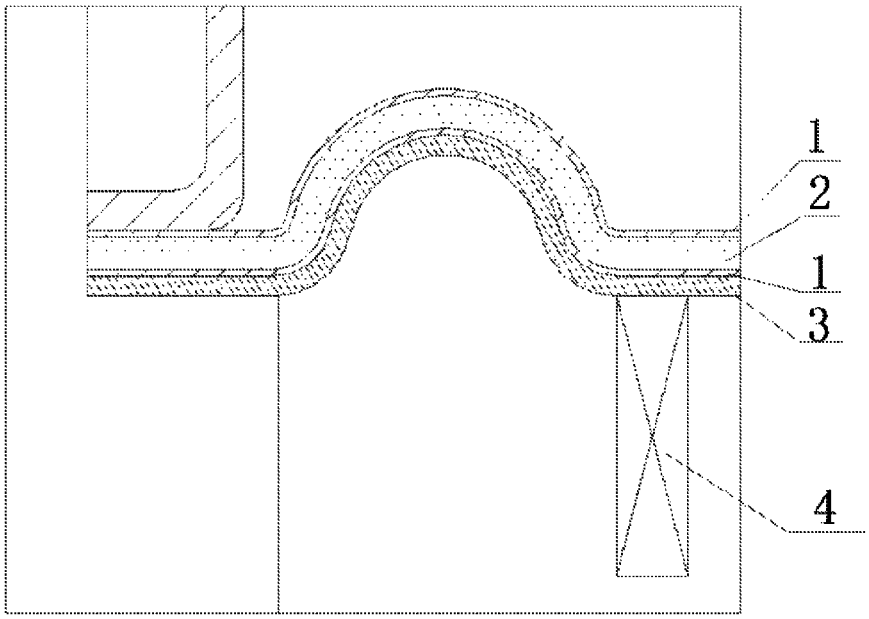
FIG. 1 is a schematic view showing the structure of the loudspeaker diaphragm according to embodiment 1 of the present application.

Wherein the reference numerals comprise: base layer 1, polyetheretherketone layer 11, polyarylester layer 12, intermediate layer 2, reinforcing layer 3, thermoplastic polyurethane elastomer layer 31, voice coil 4.

The same reference numerals in all figures indicate similar or corresponding features or functions.

DETAILED DESCRIPTION OF THE EMBODIMENTS

The present application will be described in details with reference to the accompanying drawings and particular embodiments.

In the following description, several exemplary embodiments of the present application will be described only by way of illustration. There is no doubt that various manners can be utilized by those skilled in the art to modify the embodiments without departing from the spirit and scope of the present application. Thus, the accompanying figures and the description are only illustrative, but not intended to limit the scope of the claims. In addition, in the present description, the same reference numbers indicate the same parts.

FIG. 1 to FIG. 4 show the structure of the loudspeaker diaphragm according to the embodiment of the present application in different structure forms, respectively.

As shown in FIG. 1 to FIG. 4, the loudspeaker diaphragm according to the embodiment of the present application comprises a surface layer and an intermediate layer 2, wherein the surface layer comprises a first surface layer and a second surface layer, and the first surface layer, the intermediate layer 2 and the second surface layer are bonded in a lamination way, and wherein the first surface layer and the second surface layer are located at opposite sides of the intermediate layer 2, and the surface layer coupled to the voice coil 4 of the loudspeaker may be either the first surface layer or the second surface layer.

It should be noted that at least one surface layer of the first surface layer and the second surface layer is a composite layer which is composed of a base layer 1 and a reinforcing layer 3, and the other surface layer comprises at least a base layer 1, that is, the other surface layer may be the base layer 1, or a composite layer which is composed of the base layer 1 and the reinforcing layer 3. Further, the base layer is a PEEK (polyetheretherketone) layer 11, or a PAR (polyarylester) layer 12, or a PET (polyethylene terephthalate layer), or a PEI (polyetherimide) layer or a composite layer composed of any two selected from the above layers. The reinforcing layer 3 is a TPU (thermoplastic polyurethane elastomer) layer 31 or a TPE (thermoplastic elastomer) layer, and the intermediate layer 2 is an acrylic acid adhesive layer.

Wherein when one surface layer of the two surface layers only comprises a base layer 1, respective layers of the loudspeaker diaphragm may be laminated by the following 4 ways: the base layer 1, the reinforcing layer 3, the intermediate layer 2, the base layer 1; or the reinforcing layer 3, the base layer 1, the intermediate layer 2, the base layer 1; or the base layer 1, the intermediate layer 2, the base layer 1, the reinforcing layer 3; or the base layer 1, the intermediate layer 2, the reinforcing layer 3, the base layer 1.

When each of the first surface layer and the second surface layer is a composite layer which is composed of the base layer 1 and the reinforcing layer 3, respective layers of the loudspeaker diaphragm may be laminated by the following 4 ways: the base layer 1, the reinforcing layer 3, the intermediate layer 2, the base layer 1, the reinforcing layer 3; or the base layer 1, the reinforcing layer 3, the intermediate layer 2, the reinforcing layer 3, the base layer 1; or the reinforcing layer 3, the base layer 1, the intermediate layer 2, the base layer 1, the reinforcing layer 3; or the reinforcing layer 3, the base layer 1, the intermediate layer 2, the reinforcing layer 3, the base layer 1.

During the process of installation and usage of the loudspeaker diaphragm according to the present application, one surface layer of the first surface layer and the second surface layer is coupled to the voice coil 4 of the loudspeaker. That is, either the base layer 1 of the surface layer or the reinforcing layer 3 of the surface layer may be coupled to the voice coil 4. Wherein the preferred structure is that one side of the base layer 1 of the surface layer is coupled to the voice coil 4 of the loudspeaker. When each of the first surface layer and the second surface layer is a composite layer which is composed of the base layer 1 and the reinforcing layer 3, the reinforcing layer 3 is bonded with the intermediate layer 2, or the base layer 1 is bonded with the intermediate layer 2, wherein the preferred structure is that the reinforcing layer 3 of the surface layer is bonded with the intermediate layer 2.

Wherein the material of the base layer 1 may be one or two selected from polyetheretherketone, polyetherimide, polyethylene terephthalate, and polyarylester. The material of the reinforcing layer 3 is thermoplastic polyurethane elastomer or thermoplastic elastomer. The intermediate layer 2 is located between the first surface layer and the second surface layer of the diaphragm, and the material of the intermediate layer 2 is acrylic acid adhesive. Wherein when the first surface layer or the second surface layer is a composite layer which is composed of the base layer 1 and the reinforcing layer 3, the base layer 1 is bonded with its corresponding reinforcing layer 3 by thermal compounding.

The loudspeaker diaphragm according to the present application will be described and illustrated more detail by the following several particular embodiments.

Embodiment 1

As shown in FIG. 1, the loudspeaker diaphragm according to the present embodiment comprises a first surface layer, a second surface layer and an intermediate layer 2, wherein whether the first surface layer or the second surface layer is located on the upper position relative to the intermediate layer 2 or on the lower position relative to the intermediate layer 2, which is not limited, that is, the layer close to the voice coil 4 of the loudspeaker may be either the first surface layer or the second surface layer. In the present embodiment, it is the case that the surface layer away from the voice coil 4 of the loudspeaker only comprises the base layer 1, the other surface layer close to the voice coil 4 is a composite layer which is composed of the base layer 1 and the reinforcing layer 3. Wherein the reinforcing layer 3 of the surface layer close to the voice coil 4 is coupled to the voice coil 4 of the loudspeaker, the base layer 1 is bonded with the intermediate layer 2, and the base layer 1 is bonded with the reinforcing layer 3 by thermal compounding or other methods.

Wherein the base layer 1 is a PEEK (polyetheretherketone) layer 11, or a PAR (polyarylester) layer 12, or a PET (polyethylene terephthalate layer), or a PEI (polyetherimide) layer or a composite layer composed of any two selected from the above layers. The reinforcing layer is a TPU (thermoplastic polyurethane elastomer) layer 31 or a TPE (thermoplastic elastomer) layer, and the intermediate layer 2 is an acrylic acid adhesive layer.

The toughness of the base layer of the loudspeaker diaphragm with above structure is increased by adding a reinforce layer with thermoplastic polyurethane elastomer (TPU) or thermoplastic elastomer (TPE). In addition, the flexibility and the mechanical strength of the material of the base layer is good, and when the base layer is bonded with the reinforcing layer, the acoustic performance of the loudspeaker product may be improved.

Embodiment 2

Figure 2:
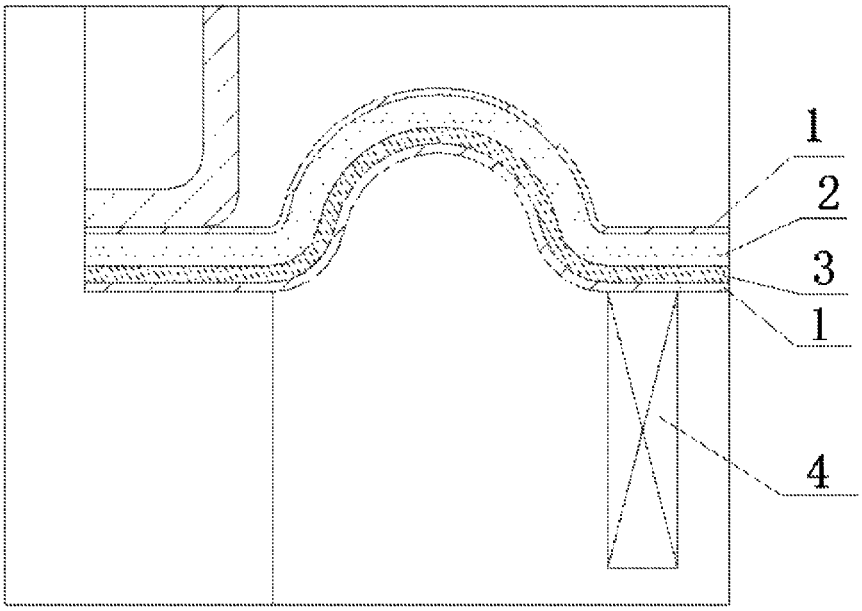
FIG. 2 is a schematic view showing the structure of the loudspeaker diaphragm according to embodiment 2 of the present application.

As shown in FIG. 2, the structure of the loudspeaker diaphragm according to the present embodiment is similar to that of embodiment 1. In the present embodiment, it is the case that the surface layer away from the voice coil 4 of the loudspeaker only comprises the base layer 1, the other surface layer close to the voice coil 4 is a composite layer which is composed of the base layer 1 and the reinforcing layer 3. Wherein the base layer 1 of the surface layer close to the voice coil 4 is coupled to the voice coil 4, and the reinforcing layer 3 is bonded with the intermediate layer 2. The base layer 1 is a PEEK (polyetheretherketone) layer, or a PAR (polyarylester) layer, or a PET (polyethylene terephthalate layer), or a PEI (polyetherimide) layer or a composite layer composed of any two selected from the above layers. The reinforcing layer is a TPU (thermoplastic polyurethane elastomer) layer or a TPE (thermoplastic elastomer) layer, and the intermediate layer is an acrylic acid adhesive layer. The intermediate layer the base layer 1 of the surface layer close to the voice coil 4 is bonded with the reinforcing layer 3 by thermal compounding.

The diaphragm with such a structure enables one side of the base layer 1 of one surface layer to be adhered to the voice coil, so as to improve the adhesive firmness between the diaphragm and the voice coil, thereby ensuring the adhesive strength therebetween. In addition, one side of the thermoplastic polyurethane elastomer (TPU) or thermoplastic elastomer (TPE) makes contact with the acrylic acid adhesive of the intermediate layer, so as to strengthen toughness of the base layer, thereby preventing the base layer from being ruptured after power experiment of the loudspeaker products and improving the reliability of the product.

Embodiment 3

Figure 3:
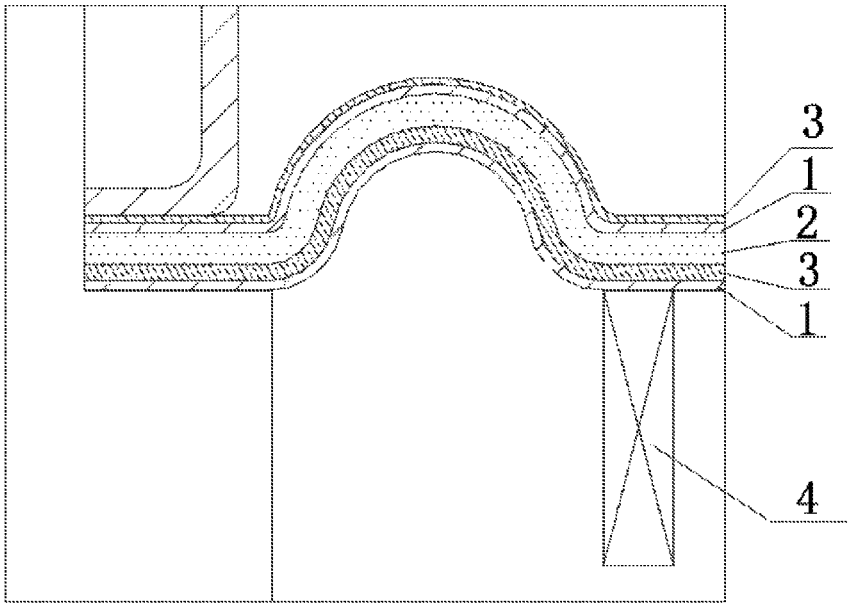
FIG. 3 is a schematic view showing the structure of the loudspeaker diaphragm according to embodiment 3 of the present application.

As shown in FIG. 3, each of the two surface layers of the loudspeaker diaphragm of the present embodiment is a composite layer which is composed of the base layer 1 and the reinforcing layer 3, wherein the base layer 1 of one surface layer of the diaphragm is adhered to the acrylic acid adhesive of the intermediate layer 2, and the base layer 1 of the other surface layer contacts with the voice coil 4. Wherein the base layer 1 is a film composed of one of polyetheretherketone (PEEK), polyetherimide (PEI), polyethylene terephthalate (PET), and polyarylester (PAR) or a composite film composed of any two selected from polyetheretherketone (PEEK), polyetherimide (PEI), polyethylene terephthalate (PET), and polyarylester (PAR). The material of the reinforcing layer 2 is thermoplastic polyurethane elastomer (TPU) or thermoplastic elastomer (TPE).

The diaphragm with such a structure is formed as a structure with five-layer films by adding a reinforcing layer 3 to each of the first surface layer and the second surface layer, which may improve the acoustic performance of the loudspeaker product effectively.

In addition, in view of adhesive firmness, in a preferred embodiment of the present application, one side of the base layer of the surface layer of the diaphragm is adhered to the voice coil. At the same time, one side of the reinforcing layer 3 of the surface layer is adhered to the acrylic acid adhesive of the intermediate layer 2, so as to increase the toughness of the base layer 1, thereby reducing the damage during the loudspeaker experiment while ensuring the acoustic performance of the loudspeaker and improving the reliability of the product.

Figure 4:
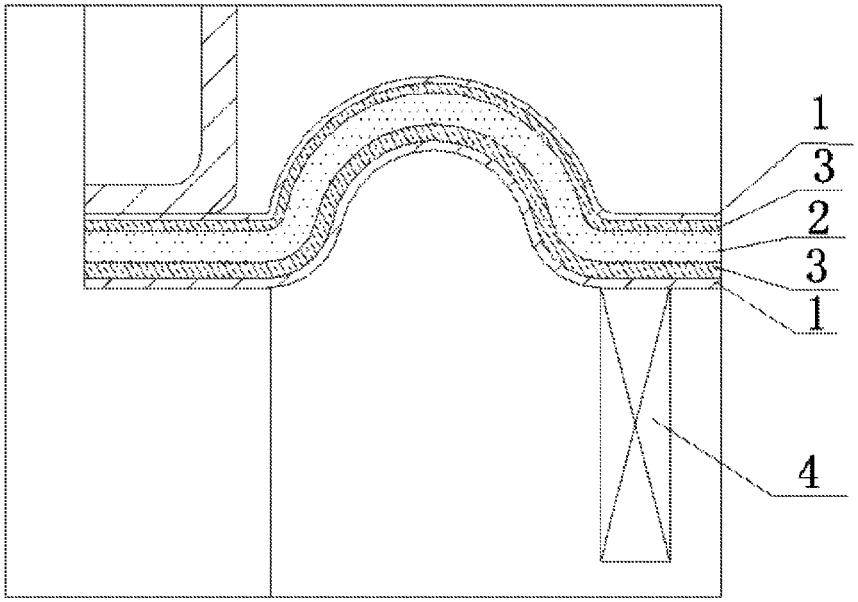
FIG. 4 is a schematic view showing the structure of the loudspeaker diaphragm according to embodiment 4 of the present application.

Embodiment 4:

As shown in FIG. 4, the loudspeaker diaphragm in the present embodiment comprises 5 layers in total, wherein each of the first surface layer and the second surface layer is formed by making the base layer 1 and the reinforcing layer 3 be thermally compound, wherein each of the reinforcing layers 3 of the two surface layers is adhered to the acrylic acid adhesive of the intermediate layer 2, and the base layer 1 of one surface layer contacts with the voice coil 4. Likewise, the base layer 1 is a film composed of one of polyetheretherketone (PEEK), polyetherimide (PEI), polyethylene terephthalate (PET), and polyarylester (PAR) or a composite film composed of any two selected from polyetheretherketone (PEEK), polyetherimide (PEI), polyethylene terephthalate (PET), and polyarylester (PAR). The material of the reinforcing layer 3 is thermoplastic polyurethane elastomer (TPU) or thermoplastic elastomer (TPE).

The diaphragm with such a structure enables the base layer to be adhered to the voice coil, so as to ensure the adhesive firmness between the voice coil and the diaphragm. Meanwhile, the reinforcing layer is adhered to the acrylic acid adhesive of the intermediate layer, so as to reinforce the toughness and intensity of the base layer and improve the performance of the diaphragm.

Figure 5:
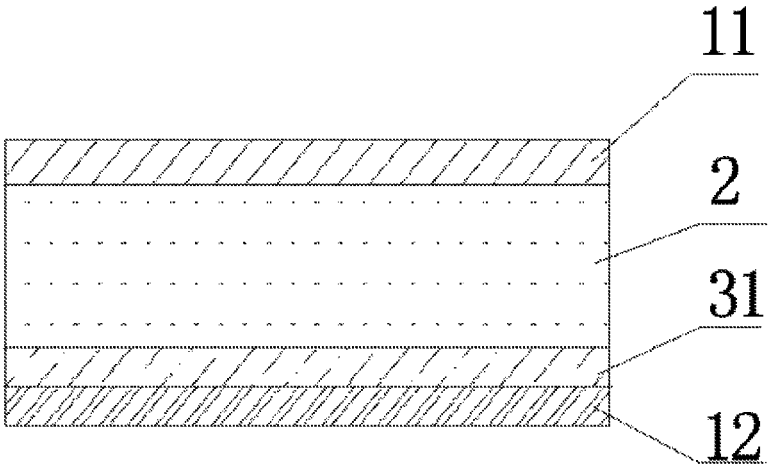
FIG. 5 is a schematic view showing the structure of the loudspeaker diaphragm according to embodiment of the present application.
Figure 6:
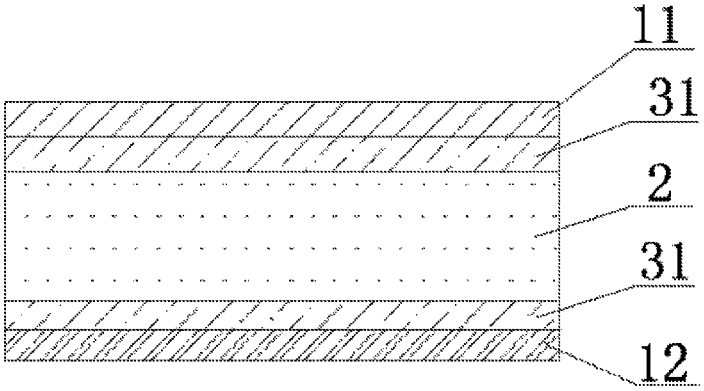
FIG. 6 is a schematic view showing the structure of the loudspeaker diaphragm according to embodiment of the present application.

FIG. 5 and FIG. 6 show the particular structure of the loudspeaker diaphragm according to the embodiment of the present application, respectively.

As shown in FIG. 5, the loudspeaker diaphragm according to the present embodiment comprises 4 layers in total, wherein the surface layer away from the voice coil of the loudspeaker is a structure with one film and its material is PEEK (polyetheretherketone) 11, and the other surface layer is a composite layer which is composed of polyarylester layer 12 and the thermoplastic polyurethane elastomer layer 31, that is, the base layer of the surface layer with a composite structure is a PAR (polyarylester) layer 12, and the reinforcing layer is a TPU (thermoplastic polyurethane elastomer) layer 31.

As shown in FIG. 6, the loudspeaker diaphragm according to the present embodiment comprises 5 layers, wherein each of the first surface layer and the second surface layer is a composite layer which is composed of the base layer 1 and the reinforcing layer 3, the base layer of the surface layer away from the voice coil of the loudspeaker is a PEEK (polyetheretherketone) layer 11, and the base layer of the other surface layer is a PAR (polyarylester) layer 12. Wherein the material of the reinforcing layer is the thermoplastic polyurethane elastomer (TPU) 31, and the material of the intermediate layer 2 is acrylic acid adhesive.

In each of the above embodiments, it should be noted that TPU is in a melt state under elevated temperature, which is equivalent to a colloid, and may increase the damping property of the diaphragm when bonded with materials of other layers. Generically, the material of the reinforcing layer 3 is selected from thermoplastic polyurethane elastomer (TPU) or thermoplastic elastomer (TPE), besides, other materials which meet the usage requirements may be selected, and colloid formed of other materials may be used for the intermediate layer. Preferably, the thickness of the reinforcing layer is in a range of 5~40 μm (1000 μm=1 mm), and the shore hardness is 60~95 A. The material of the base layer is one or two selected from of polyetheretherketone (PEEK), polyetherimide (PEI), polyethylene terephthalate (PET), and polyarylester (PAR), and other materials which meet the requirements of the product may be used as well. Preferably, the thickness of the base layer is 2~30 μm.

In addition, the present application only shows several types of structures of the diaphragm, and the base layer and the reinforcing layer may be bonded in other ways, and other materials may also be used to the base layer and reinforcing layer as long as the mass and the performance of the loudspeaker product can be ensured.

When the loudspeaker diaphragm according to the present application is used, the front and back surfaces should be marked so as to avoid perversion during the process of installation which will affect the bonding strength between the diaphragm and the voice coil and thus degrade the acoustic performance of the loudspeaker product.

As can be seen from the above implementations, the toughness and intensity of the loudspeaker diaphragm according to the present application may be increased by using the combination of a base layer and a reinforcing layer as the base material of a composite diaphragm, so as to prevent the diaphragm from being ruptured after power test is performed on a loudspeaker product, thereby improving the reliability and acoustic performance of the loudspeaker product.

As described above, the loudspeaker diaphragm according to the present application is described by way of example with reference to the accompanying drawings. However, it should be understood by those skilled in the art that, other improvements and variations can be made to the loudspeaker diaphragm according to the present application without departing from the contents of the present application, and the improvements and variations will fall into the scope of the present application. It will be understood by those skilled in the art that the above specific description intends to better illustrate the present application, the scope of the present application is defined by the claims and its equivalents.

The invention claimed is:

1. A loudspeaker diaphragm, comprising a first surface layer, an intermediate layer and a second surface layer in a lamination structure, wherein at least one surface layer of the first surface layer and the second surface layer is a composite layer composed of a base layer and a reinforcing layer, and the other surface layer comprises at least a base layer, and the base layer is any one selected from a group consisting of a polyetheretherketone layer, a polyarylester layer, a polyethylene terephthalate layer and a polyetherimide layer, or a composite layer composed of any two selected from the group;

the reinforcing layer is a thermoplastic polyurethane elastomer layer or a thermoplastic elastomer layer.

2. The loudspeaker diaphragm according to claim 1, wherein one surface layer of the first surface layer and the second surface layer is coupled to a voice coil of a loudspeaker.

3. The loudspeaker diaphragm according to claim 2, wherein the one surface layer coupled to the voice coil of the loudspeaker is coupled to the voice coil through its base layer.

4. The loudspeaker diaphragm according to claim 1, wherein when the other surface layer only comprises the base layer, a lamination order of the loudspeaker diaphragm is as follows:

the base layer, the reinforcing layer, the intermediate layer, the base layer;

the reinforcing layer, the base layer, the intermediate layer, the base layer;

the base layer, the intermediate layer, the base layer, the reinforcing layer; or the base layer, the intermediate layer, the reinforcing layer, the base layer.

5. The loudspeaker diaphragm according to claim 1, wherein each of the first surface layer and the second surface layer is the composite layer composed of the base layer and the reinforcing layer.

6. The loudspeaker diaphragm according to claim 5, wherein a lamination order of the loudspeaker diaphragm is as follows:

the base layer, the reinforcing layer, the intermediate layer, the base layer, the reinforcing layer;

the base layer, the reinforcing layer, the intermediate layer, the reinforcing layer, the base layer;

the reinforcing layer, the base layer, the intermediate layer, the base layer, the reinforcing layer; or the reinforcing layer, the base layer, the intermediate layer, the reinforcing layer, the base layer.

7. The loudspeaker diaphragm according to claim 1, wherein the intermediate layer is an acrylic acid adhesive layer.

8. The loudspeaker diaphragm according to claim 1, wherein when the surface layer is the composite layer composed of the base layer and the reinforcing layer, the base layer bonds with the reinforcing layer by thermal compounding.

9. The loudspeaker diaphragm according to claim 1, wherein a thickness of each of the first surface layer and the second surface layer is 2~30 μm.

10. The loudspeaker diaphragm according to claim 1, wherein a thickness of the reinforcing layer is 5~40 μm, and a hardness of the reinforcing layer is 60~95 A Shore hardness.

* * * * *